United States Patent [19]

Higgins

[11] Patent Number: 4,963,198

[45] Date of Patent: Oct. 16, 1990

[54] COMPOSITION AND PROCESS FOR TREATING METAL SURFACES

[75] Inventor: George L. Higgins, Windsor, Great Britain

[73] Assignee: Brent Chemicals International plc, United Kingdom

[21] Appl. No.: 307,730

[22] Filed: Feb. 7, 1989

[30] Foreign Application Priority Data

Feb. 8, 1988 [GB] United Kingdom ..... 8802788

[51] Int. Cl.[5] ..... C23C 22/60

[52] U.S. Cl. ..... 148/267

[58] Field of Search ..... 148/267

[56] References Cited

U.S. PATENT DOCUMENTS 2,911,332 11/1959 Schuster ..... 148/267

3,935,035 1/1976 Tanaka ..... 148/267

4,801,337 1/1989 Higgins ..... 148/267

FOREIGN PATENT DOCUMENTS 441088 2/1936 United Kingdom .

899599 6/1962 United Kingdom .

1042108 9/1966 United Kingdom .

*Primary Examiner*—Sam Silverberg

*Attorney, Agent, or Firm*—Harris, Kern, Wallen & Tinsley

[57] ABSTRACT

An alkaline aqueous solution comprising hexavalent chromium, trivalent chromium, and a complexing agent for trivalent chromium sufficiently effective to solubilize at least 20 ppm of trivalent chromium forms a protective coating when contacted with zinc, aluminum, and particularly zinc-aluminum alloys.

13 Claims, No Drawings

COMPOSITION AND PROCESS FOR TREATING METAL SURFACES

This invention relates to processes and compositions that can be used satisfactorily for treating, interchangeably, surfaces of zinc or surfaces containing aluminium, for instance as a zinc aluminium alloy.

It is known to form conversion coatings on aluminium and conventional aluminium alloys from an alkaline chromate solution containing trivalent chromium. Thus a process is described in GB No. 441,088 comprising contacting the metal with an aqueous composition containing sodium carbonate, sodium chromate and a third component that is exemplified as sodium mono hydrogen phosphate or chromium carbonate. In commercial practice the process is conducted by prolonged immersion in a hot aqueous solution of sodium carbonate, sodium chromate and chromic oxide. The concentration of hexavalent chromium typically is around 13 g/l $CrO_3$ but the concentration of dissolved trivalent chromium will be extremely low (of the order of 1 ppm) even if the solution is saturated in chromic oxide, because of the very low solubility of trivalent chromium at the high pH value of the solution. It seems that the relatively thick coating that is formed is of aluminium and trivalent chromium oxide.

The process has a number of disadvantages. Thus the coatings are of variable appearance, for instance being mottled green and/or brown. The treatment typically requires immersion for five minutes at 90° to 100° C., and the high hexavalent chromium concentration in the solution necessitates expensive effluent treatment These disadvantages severely limit the applicability of the process to aluminium and render it impracticable for extension to zinc surfaces.

It is proposed in GB No. 899,599 to form subtantially colourless chromate coatings on surfaces of zinc or conventional zinc alloys by treatment with a highly acidic (pH 0.2 to 2.8) solution containing hexavalent chromium and trivalent chromium. The concentration of hexavalent chromium typically is 10g/l chromium trioxide and so again expensive effluent treatment may be required The highly acidic nature of the chromate solution renders the solution very aggresive, thus limiting the choice of plant materials. The process cannot satisfactorily be used for treating aluminium, since acidic solutions tend to be ineffective on aluminium unless they contain fluoride, and the use of acid fluoride is unsatisfactory in practice on zinc.

An alkaline process for treating zinc and conventional zinc alloys is described in GB No. 1,042,108. In this, the zinc surface is contacted with a chromate-free aqueous alkaline solution having a pH above 11 and which contains a metal of a group of the periodic system other than group 1. Most of the examples show the use of metals such as iron, cobalt or magnesium but trivalent chromium is mentioned as a metal that can be used. The use of hexavalent chromium is specifically excluded since it is said to interfere with the formation of the desired coating of zinc surfaces.

Conventional zinc alloys were substantially free of aluminium and conventional aluminium alloys were substantially free of zinc. Recently however zinc aluminium alloys have been developed containing substantial amounts of both zinc and aluminium, typically about 97% zinc and 3% aluminium to 30% zinc and 70% aluminium. Particular alloys of this type are 5% aluminium 95% zinc and 55% aluminium 45% zinc Such alloys can be used interchangeably with conventional zinc and zinc alloys in the production of hot dip galvanised steel and other coated steels. It would be desirable to be able to provide a treatment that was highly effective on both types of surface so that, for instance, the process could be applied to steel strip galvanised interchangeably with zinc or zinc aluminium alloy. None of the existing processes and compositions meet this requirement.

An aqueous alkaline solution according to the invention contains dissolved hexavalent chromium in a concentration suitable for forming a coating on zinc or aluminium, trivalent chromium, and at least one complexing agent for complexing with the trivalent chromium and for holding at least 20 ppm trivalent chromium dissolved in the solution. The solution normally has a pH of above 12. This can be such that the saturation value of dissolved trivalent chromium, in the absence of complexing agent, would be of the order of 1 ppm. Thus in the invention the amount of dissolved trivalent chromium is very much higher than exists in, for instance, the solutions of GB No. 441,088.

The hexavalent chromium may be introduced in the form of any suitable soluble chromate, preferably as alkali metal chromate.

If the concentration of hexavalent chromium is too low then either no coating will be formed or the coating will give inadequate protection. In general the concentration needs to be at least 8 ppm. If the concentration is too high then, in the conditions prevailing in the solution, the solution will have the effect of passivating the metal in preference to reacting with it to form a protective coating. In general the concentration should be not more than 75 ppm with best results generally being obtained in the range 15 to 60 ppm.

The trivalent chromium may be added as any suitable soluble trivalent chromium compound, generally as a trivalent chromium salt. Although the resultant coating is usually rinsed with water it is desirable to use a salt that provides anions that do not cause corrosion problems and preferably the anions are selected from nitrates, sulphates, phosphates and acetates. Halides, especially chloride, are preferably not used. Carbonate could be used but would have to be introduced in acidic solution and so alkali would have to be added subsequently.

Instead of introducing the trivalent chromium as a trivalent chromium compound, it is also possible to generate it within the solution by incorporating hexavalent chromium in an amount greater than is required for the process and reducing the excess hexavalent chromium in situ to form a blend of the required amounts of trivalent and hexavalent chromium. This reduction would normally have to be conducted under acidic conditions and so alkali would have to added after the reduction. The reduction can be achieved by, for instance, incorporating appropriate organic reducing agents in the solution, in known manner.

If the concentration of trivalent chromium is lower than 30 ppm then coating formation will proceed too slowly to be satisfactory, and in practice the concentration should generally be above 50 ppm. Normally the amount is above this, e.g., 100 to 500 ppm. There is generally no advantage in increasing the concentration above, for instance, 700 ppm.

The pH of the solution generally needs to be above 12 as otherwise the process is too slow, and in practice it is normally at least 12.5. The high pH is generated by incorporation of a suitable non-interfering alkali. Sodium silicate may tend to interfere with the process by passivating some surfaces, especially aluminium. Sodium phosphate could be used but tends to be expensive. Sodium carbonate could be used for some of the alkali but would tend to be incapable by itself of giving a sufficiently high pH. The preferred alkalis therefore are alkali metal hydroxides such as potassium hydroxide or, especially, sodium hydroxide. The amount of this is generally at least 10 g/l but below 80 g/l since if the concentration is too high the solution is liable to attack the zinc and aluminium surfaces too vigorously, rather than form coatings on them.

Any complexing agent capable of holding an adequate amount of the trivalent chromium in solution may be used and a wide variety of such materials exist. However best results are obtained if part or all of the complexing agent is an organic compound containing both hydroxy and carboxylic groups. One such compound is citric acid but the preferred compounds for use in the invention are heptonic and gluconic acids, generally introduced as their sodium salts.

Another preferred type of complexing agent is the amine carboxylic acid type, generally in combination with the hydroxy carboxylic acid type. The inclusion of the amine carboxylic acid type tends to increase the efficiency of the process and to result in a more uniform attack and the formation of a more even protective coating. The preferred complexing agents of this type are nitrilo triacetic acid and ethylene diamine tetra acetic acid (NTA and EDTA). These complexing agents are preferably introduced as the full sodium salt.

The total amount of complexing agent must be sufficient to hold the desired amount of trivalent chromium in solution, and is generally present in excess. Preferably the amount of hydroxy carboxylic acid complexing agent is in excess over the theoretical, and is generally in the range 0.2 to 10 g/l If amine carboxylic acid complexing agent is present, suitable amounts are 0.5 to 10 g/l, these concentrations all being measured on the full sodium salt.

The aqueous solution may be made by dissolving the individual ingredients into water but can be made by dissolving a concentrate containing the trivalent compound, hexavalent compound and complexing agent or agents in water, and by providing alkali either in this concentrate or separately. Suitable concentrates can have a solids content of 15 to 40% typically 25 to 35% and may contain the active ingredients in the same proportions as are described for the working solutions, and the working solutions can be made merely by diluting with an appropriate amount of water.

The invention includes a process for forming a protective coating on a metal surface which may be of zinc, aluminium or alloys of either or both, in particular zinc aluminium alloys, by contacting the surface with the described aqueous solution. Although the invention includes processes in which the treatment is conducted on a surface of a single metal type, e.g., zinc, the invention is of particular value in processes where the solution is used for treating different types of metal surfaces either simultaneously or sequentially, for instance when the solution is used for treating both zinc and zinc aluminium alloy surfaces simultaneously or, usually, sequentially. Thus hot dipped zinc or zinc-aluminium alloy galvanised steel strip may be treated interchangeably without making any deliberate changes in the content of the solution that is used.

Contact may be by spraying or by immersion. The duration of contact can usually be very short, for instance 5 to 15 seconds, but longer contact times, e.g., up to one minute, may be required in some processes, for instance when the trivalent chromium concentration or temperature is relatively low. The solution temperature will normally be below 70° C., generally in the range 40° to 60° C. The metal will generally be at a temperature of 30° to 50° C., often around 40° C., prior to the treatment.

The coating is generally rinsed with water, usually by spraying Preferably it is then given a rinse with a chromate solution, preferably as described in GB No. 1084478 It is then dried.

The coating gives good corrosion resistance and can be left untreated, but generally is used as a base for a paint, which may be of any conventional colourless or coloured formulation.

EXAMPLE 1

A working composition is formed from

| | |
|---|---|
| Sodium hydroxide | 70 g/l |
| $Cr(NO_3)_3\ 9H_2O$ | 2 g/l |
| $K_2Cr_2O_7$ | 0.2 g/l |
| $NTA.Na_3$ | 5 g/l |
| Sodium heptonate | 2 g/l |

This composition is applied by spraying at 50° C. for 15 seconds to steel strip which interchangeably is zinc galvanised or zinc-aluminium alloy galvanised (the alloy being 5% aluminium 95% zinc). The coating is rinsed with water by spraying and dried It is then painted with an epoxy primer and a silicous polyester topcoat. It was tested to ASTM-B117 in salt spray for 1500 hours and after exposure there was less than 1 mm breakdown of the paint from a cross-score.

EXAMPLE 2

A concentrate is formed from:

| | |
|---|---|
| $Cr(NO_3)3.9H_2O$ | 114 |
| $K_2Cr_2O_7$ | 3 |
| $NTA\ Na_3$ | 75 |
| Na Heptonals | 25 |
| NaOH | 110 |
| $H_2O$, to make 1000 parts | |

A working composition can be made from this by dilution in the proportions 10:1.

What is claimed is:

1. An aqueous alkaline solution suitable for forming a protective coating on zinc, aluminum, and alloys thereof, comprising:

(a) dissolved hexavlent chromium in an amount in the range 8–75 ppm (b) a dissolved complexing agent for trivalent chromium ions; and (c) dissolved trivalent chromium in an amount in the range 20–700 ppm, said solution having a pH above 12.

2. A solution according to claim 1, wherein the content of hexavalent chromium is between 15 60 ppm.

3. A solution according to claim 2, wherein the amount of dissolved trivalent chromium is between 30 and 700 ppm.

4. A solution according to claim 1, wherein the amount of dissolved trivalent chromium is between 100 and 500 ppm.

5. A solution according to claim 4, in which the pH is at least 12.5.

6. A solution according to claim 1, containing between 10 and 80 g/l of sodium hydroxide.

7. A solution according to claim 1, in which the complexing agent comprises an organic compound containing both hydroxy and carboxyl groups and is present in an amount between 0.2 and 10 g/l.

8. A solution according to claim 7 in which the organic compound is citric acid, heptonic acid, or gluconic acid.

9. A solution according to claim 8 additionally comprising an amino carboxylic acid in an amount between 0.5 and 10 g/l.

10. A solution according to claim 9 in which the aminocarboxylic acid is nitriloacetic acid or ethylene diamine tetraacetic acid.

11. A process for forming a protective coating on a surface of zinc, aluminum, or an alloy of zinc or aluminum, comprising contacting the surface with a solution comprising:

(a) dissolved hexavlent chromium in an amount in the range 8–75 ppm;

(b) a dissolved complexing agent for trivalent chromium ions; and (c) dissolved trivalent chromium in an amount in the range 20–700 ppm, said solution having a pH above 12; and then rinsing the surface.

12. A process according to claim 11, in which the surface contacted comprises an alloy of both aluminum and zinc.

13. A process according to claim 12, in which the surface contacted also comprises a zinc surface.

* * * * *